United States Patent [19]

Shelton et al.

[11] 4,440,353

[45] Apr. 3, 1984

[54] TEXTILE MACHINE ARRANGEMENT

[75] Inventors: William E. A. Shelton, Oadby; David C. Corby, Cosby, both of England

[73] Assignee: Alan Shelton Limited, Croft, England

[21] Appl. No.: 321,775

[22] Filed: Nov. 16, 1981

[30] Foreign Application Priority Data

Nov. 19, 1980 [GB] United Kingdom ..... 8037020

[51] Int. Cl.[3] ..... B65H 51/22

[52] U.S. Cl. ..... 242/47.01; 66/125 R; 66/132 R; 242/47.13; 242/131

[58] Field of Search ..... 242/47.01, 47.04, 47.05, 242/47.08, 47.09, 47.1, 47.12, 47.13, 131, 131.1; 66/125 R, 132 R

[56] References Cited

U.S. PATENT DOCUMENTS

| | | | |
|---|---|---|---|
| 2,317,747 | 4/1943 | Ewing | 242/47.1 |
| 2,444,315 | 6/1948 | Sever | 242/47.09 |
| 2,576,233 | 11/1951 | Lorig | 242/47.13 |
| 2,589,411 | 3/1952 | Lorig | 242/47.09 X |
| 4,043,154 | 8/1977 | Merkle | 66/125 R |

FOREIGN PATENT DOCUMENTS

| | | | |
|---|---|---|---|
| 2333687 | 1/1975 | Fed. Rep. of Germany | 66/125 R |
| 2360507 | 6/1975 | Fed. Rep. of Germany | 66/125 R |
| 2507815 | 9/1975 | Fed. Rep. of Germany | 66/125 R |
| 765976 | 4/1934 | France | 242/47.13 |
| 1351121 | 4/1974 | United Kingdom | 242/131 |

OTHER PUBLICATIONS

Charles Reichman, Mills Modernizing Machines with Free-Standing Yarn Creels, Knitted Outerwear Times, Mar. 31, 1969, vol. 38, No. 13, pp. 43–45.

*Primary Examiner*—Stanley N. Gilreath
*Attorney, Agent, or Firm*—Charles E. Brown

[57] ABSTRACT

The invention comprises a textile machine arrangement comprising a multiplicity of yarn sources adapted to supply yarn for each feed station on said machine, said yarn sources being located adjacent to the machine, and a yarn feed mechanism adapted to draw the yarns from the sources and feed them at a desired rate and tension along a path towards the appropriate feed stations, characterized in that said yarn sources (2) are located in at least one group arranged to one side of the machine (4), and that the yarn feed mechanism includes a rotatable elongate roller device (8) provided with a plurality of cylindrical path-defining surface portions (21) each rotatable simultaneously and co-axially with its neighboring surface portion (21), so that each yarn is fed to one only of the portions (21) and the yarn path of each yarn (Y) includes a region in which the yarn partakes of travel in a helical manner about a portion (21) of the cylindrical surface of the roller device (8).

5 Claims, 3 Drawing Figures

TEXTILE MACHINE ARRANGEMENT

The invention is concerned with supplying yarn to a textile machine. The invention is particularly, though not exclusively, suitable for use with circular knitting machines having more than twenty four feed stations.

In a conventional arrangement, a knitting machine is provided with a multiplicity of yarns, each yarn being drawn from a bobbin or cone and supplied to a feed station of the machine. Banks of such bobbins or cones are mounted upon stands, usually known as creels, and it is necessary to provide a feeding mechanism which is located between the creel and the knitting location, which serves to draw the yarn from the creel and deliver it to the knitting location at the correct speed and tensions. Examples of this type of device are described in U.K. patent specification No. 920,527 or alternatively in U.K. patent specification No. 2,021,165. These devices have been very effectively and successfully used on many knitting machines particularly multi-feed jersey circular machines.

A draw-back with the above-mentioned devices is that they require one feedwheel for each yarn or at least one wheel for two yarns and are, therefore, relatively complicated, which in turn means that equipping these multi-feed machines is expensive. A further disadvantage with these known feedwheels is that they are located around the upper part of the knitting machine requiring the operator to move around the machine to find a trouble spot which is overhead and therefore relatively inaccessible. The belts which drive these feedwheels must also pass around the machine making them long and, therefore, relatively expensive. The belts are normally unguarded which represents a safety hazard.

With the aim of minimising the effect of the above problems, the invention provides a textile machine arrangement comprising a multiplicity of yarn sources adapted to provide yarn for each feed station on said machine, said yarn sources being located laterally of the machine, and a yarn feed mechanism adapted to draw the yarns from the sources and feed them at a desired rate and tension along a path towards the appropriate feed stations, wherein said path includes a region in which each yarn partakes of travel in a helical manner about a cylindrical surface portion arranged between said sources of yarn and the feed stations, a plurality of the cylindrical surface portions being formed on a rotatable elongate roller device so that each surface portion rotates simultaneously and co-axially with its neighbouring surface portion(s), yarn guide means being provided in association with each cylindrical surface portion to control the helical movement of the yarn travelling therearound.

Advantageously, the rate of rotation of the roller is governed by the speed of operation of the knitting machine. Conveniently stop motion devices may be provided to detect the incorrect running of any of the yarns, and these devices may advantageously be mounted adjacent the roller rather than around the upper part of the knitting machine as has hitherto been customary.

In an example of the invention to be described in detail below, the knitting machine is a circular knitting having seventy two feed stations, although it will be understood that the benefits of the invention may be obtained with multifeed machines having as few as, say, twenty four stations. The yarns supplied to the machine in the example are divided into two groups each group being drawn from a creel supporting the requisite number of bobbins or reels to maintain a continuous supply of thirty-six yarns.

Each group of thirty-six yarns is controlled by two co-axially arranged roller devices arranged in an end-to-end layout. These devices may be elongate cylindrical rollers provided with yarn guiding means such as pot eyes or may, as in the example to be described below, comprise a series of rods around which the yarn is wound in its helical travel.

The invention also provides a yarn feed device for use with a textile machine and including an elongate rotary means comprising a plurality of parallel disposed rods arranged in an annular formation, and a plurality of plates arranged at intervals along said rods and each provided with a plurality of apertures through each of which is slidingly received one of said rods, the plates being fixedly mounted upon a centrally disposed shaft so as to extend radially thereof or substantially so, end portions of said shaft flanking said plates, and rods being mounted for rotation with respect to an obliquely mounted end plate against which end surfaces of the rods impinge so that rotation of the shaft causes lengthwise movement of the rods with respect to the apertured plates.

There will now be given a description of an example of an arrangement according to the invention. It will be understood that the description, which is to be read with reference to the accompanying drawings, is given by way of example only and not by way of limitation.

Figure 1:
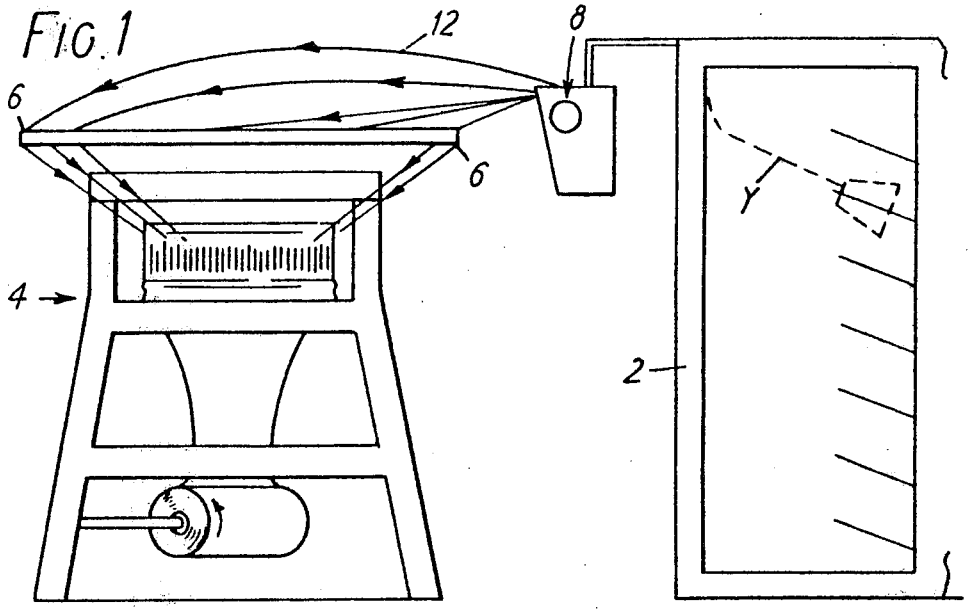
FIG. 1 is a diagrammatic side view of an arrangement according to the invention.

The arrangement shown in FIG. 1 comprises a plurality of bobbins (not shown) supported on a creel assembly 2, all yarns from the bobbins being drawn off from an upper region of the creel. The creel assembly 2 is positioned at one side of a circular knitting machine, indicated at 4, having seventy two feed stations 6 each receiving a yarn which leaves the creel assembly and travels to its respective feed station along a path which includes a helical portion.

Figure 2:
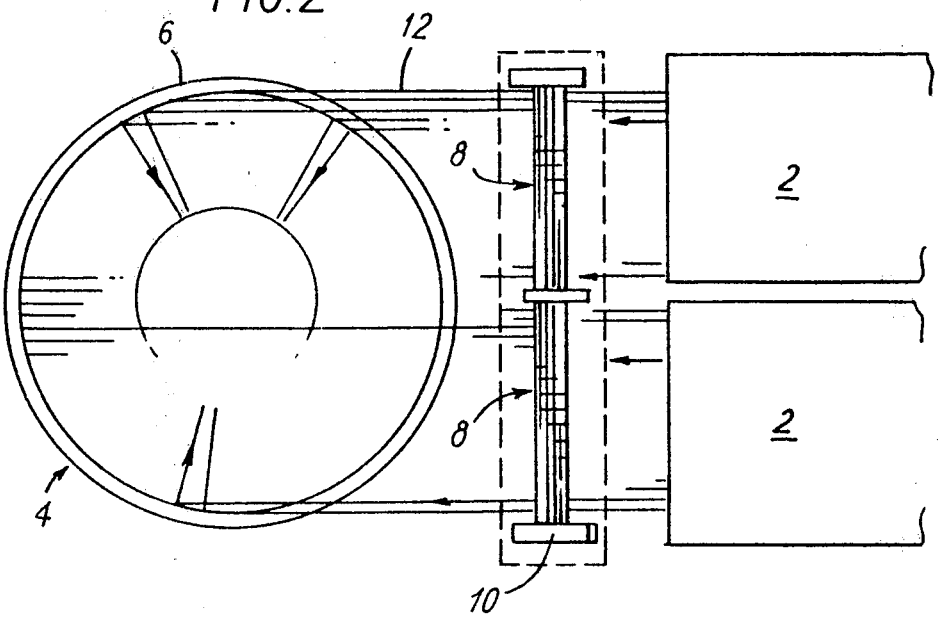
FIG. 2 is a plan view of the same.

The helical portion of the path is provided by causing each yarn to form at least one turn about a cylindrical surface provided on a rotatable elongate roller device indicated at 8. In the present example approximately five turns are formed on the cylindrical portion to enable the roller device to function in a manner comparable with a conventional multi-wrap positive feed device. The roller device of the present example comprises two co-axially rollers arranged end to end (see FIG. 2) and these are driven by belt means (not shown) associated with the knitting machine 4, so that the speed of rotation of the rollers, and therefore the rate of feed, may be controlled according to the requirements of the knitting machine. Each roller is mounted on a frame 10 which supports a drive mechanism. Yarn leaving the rollers via a stop motion device (not shown) then travels direct to the appropriate feed station 6. The yarn may travel direct if desired or may be led through guide tubes (indicated in dotted lines at 12) if preferred.

Figure 3:
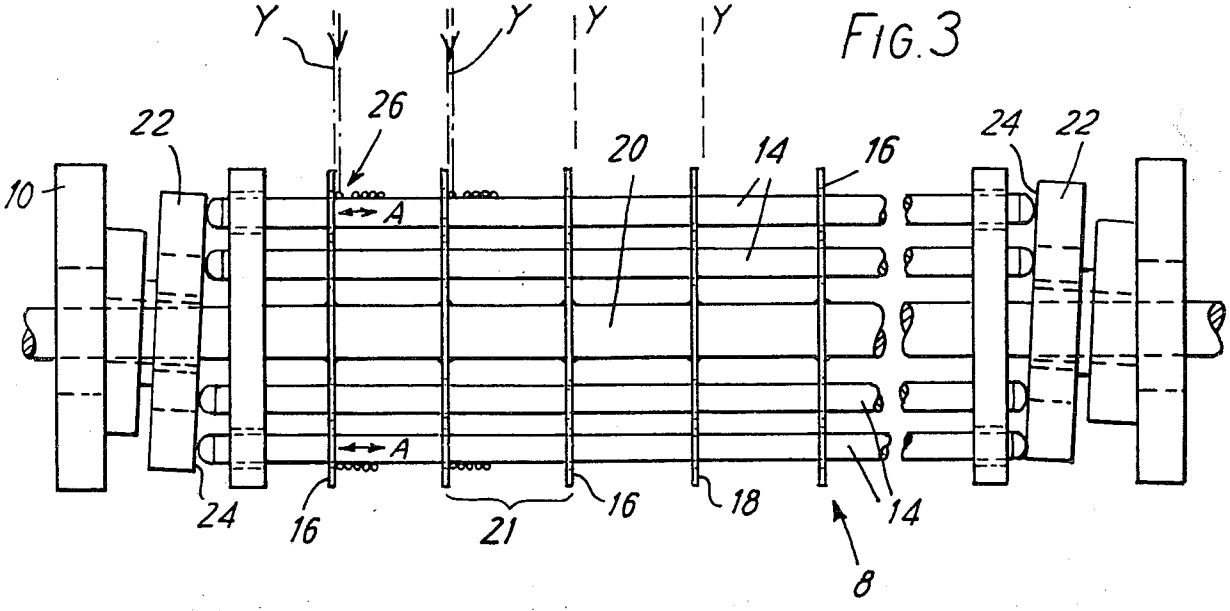
FIG. 3 shows details of a rotary means according to the invention.

The construction of the rollers will now be described with reference to FIG. 3.

Each roller 8 comprises six parallel disposed rods 14 (two shown) arranged in an annular formation. Thirty six plates 16 (five shown) are arranged at equal intervals along the rods, each plates having six apertures 18 aligned with the six apertures of its neighbouring plates so that the rods are slidably received in these apertures to form a cylindrical lay-out. The plates 16 are fixedly mounted on and rotate with a central shaft 20 mounted for rotation with respect to the frame 10 by the belt means (not shown) driven from the knitting machine. It will be understood that a cylindrical surface portion 21 of the roller is defined as lying between two neighbouring plates 16.

Fixedly mounted on the frame 10 so that the shaft 20 is received in a central aperture thereof is an end plate 22, one said end plate being mounted at each of the two ends of the roller 8. End surfaces of the rods 14, which are rounded, impinge upon an oblique surface 24 of the end plates 22 so that as the shaft 20 and the plates 16 rotate, the rods 14 are caused not only to move rotationally but also to move longitudinally of the shaft due to their contact with the oblique surface 24.

In operation, each yarn Y travels from the creel and is received at an entry point 26 immediately adjacent a plate 16 while the rod at that point is in a position at the right hand end of its longitudinal travel indicated by the double arrows A. As the rods 14 and plates 16 rotate through 180°, the rod 14 moves to the left hand end of it longitudinal travel (see position of lowest rod in FIG. 3) but because the plate 16 is in a radial plane with respect to the roller, the rod 16 slides with respect to the yarn being wrapped around it and its neighbouring rods forming the roller 8. Thus when the rod 16 returns to an upper position adjacent the yarn entry point 26 the last wound turn of yarn is now spaced from the plate 16 so as to enable the next turn to be formed onto an uncovered portion of the rod 14.

Thus a plurality of turns are formed on the roller 8 in a controlled manner, and the yarn then leaves the roller, after completing its helical path, to travel to the knitting machine.

We claim:

1. A textile machine arrangement comprising a textile machine having a multiplicity of feed stations, a multiplicity of yarn sources for supplying yarn for each feed station on said machine, said yarn sources being located adjacent to said machine, and a yarn feed mechanism for drawing yarns from said sources and feeding them at a desired rate and tension along a path towards the appropriate ones of said feed stations, said machine arrangement being characterized in that said yarn sources are located in at least one group arranged to one side of said machine, and that said yarn feed mechanism includes a rotatable elongate roller device having a plurality of cylindrical path-defining surface portions each rotatable simultaneously and co-axially with a neighboring surface portion whereby each yarn is fed to one only of said surface portions and the yarn path of each yarn includes a region in which the yarn partakes of travel in a helical manner about a respective cylindrical surface portion of said roller device, said elongate roller device having a plurality of parallel disposed rods arranged in an annular formation, a plurality of plates arranged at intervals along the rods and each being provided with a plurality of apertures through each of which is slidingly received one of said rods, the portions of said rods between adjacent ones of said plates defining said surface portions, said plates being fixedly mounted upon a centrally disposed shaft and extending at least substantially radially thereof with end portions of said shaft flanking said plates, a stationary end plate having an oblique surface, and said rods being mounted for rotation with respect to said oblique surface of said stationary end plate and having oblique end surfaces which impinge against said oblique surface of said stationary end plate whereby rotation of said shaft causes lengthwise movement of said rods with respect to said apertured plates.

2. A machine arrangement as claimed in claim 1, characterized in that the axis of rotation of said roller device is at least substantially horizontal.

3. A machine arrangement as claimed in claim 2, characterized in that there are two groups of said yarns sources each arranged at one side of said machine with each yarns sources group serving one half of the feed stations and all yarns from said two groups travelling from said sources to said yarn feed mechanism in parallel paths.

4. A machine arrangement as claimed in claim 1, characterized in that the yarns leaving said yarn feed mechanisms travel to said feed stations through guide tubes.

5. A feed mechanism as claimed in claim 1, characterized in that there are two of said roller devices each having six of said parallel rods, and there are thirty six plates arranged along the length of said rods.

* * * * *